US006048198A

United States Patent [19]

Okada et al.

[11] Patent Number: 6,048,198

[45] Date of Patent: Apr. 11, 2000

[54] CATALYTIC COMBUSTION TYPE HEATER

[75] Inventors: Hiroshi Okada; Sadahisa Onimaru, both of Nishio, Japan

[73] Assignee: Nippon Soken, Inc., Nishio, Japan

[21] Appl. No.: 09/126,813

[22] Filed: Jul. 31, 1998

[30] Foreign Application Priority Data

Jul. 31, 1997 [JP] Japan ..... 9-220990

[51] Int. Cl.[7] ..... F23D 14/12; F23N 5/20; F23N 11/44

[52] U.S. Cl. ..... 431/328; 431/6; 431/12; 431/62; 431/72; 431/326

[58] Field of Search ..... 431/6, 7, 11, 12, 431/328, 62, 72, 73, 67, 326, 28, 29; 126/91 R, 91 A

[56] References Cited

U.S. PATENT DOCUMENTS

| | | | |
|---|---|---|---|
| 4,019,316 | 4/1977 | Pfefferle | 60/39.02 |
| 4,112,675 | 9/1978 | Pillsbury et al. | 60/39.06 |
| 4,784,599 | 11/1988 | Garbo | 431/7 |
| 5,127,822 | 7/1992 | Nakayama et al. | 431/10 |
| 5,137,444 | 8/1992 | Grebe et al. | 431/1 |
| 5,421,719 | 6/1995 | Saito et al. | 431/7 |

FOREIGN PATENT DOCUMENTS

| | | |
|---|---|---|
| 3-140705 | 6/1991 | Japan . |
| 7-293864 | 11/1995 | Japan . |

*Primary Examiner*—Ira S. Lazarus
*Assistant Examiner*—David Lee
*Attorney, Agent, or Firm*—Pillsbury Madison & Sutro LLP

[57] ABSTRACT

A catalytic combustion type heater set so as to reduce the exhaust emission at the time of ignition and the time of extinguishment by, at the time of ignition, providing a precombustion period and making the amounts of the fuel and air fed larger than the air-fuel ratio of the steady combustion period to prevent incomplete combustion and by, at the time of extinguishment, stopping the feeding of fuel and feeding only air in an amount lower than that before the fuel stops being fed so as to completely burn the remaining fuel, then feeding purging air.

8 Claims, 5 Drawing Sheets

CATALYTIC COMBUSTION TYPE HEATER

BACKGROUND OF THE INVENTION

1. Field of the Invention

The present invention relates to a catalytic combustion type heater, more particularly relates to an improvement of an exhaust emission at the time of ignition and at the time of extinguishment.

2. Description of the Related Art

A catalytic combustion type heater is used for heating a vehicle. The heater has a heat chamber in which a heating element carrying a catalyst is disposed. An air-fuel mixture comprising part of the vaporized fuel for use by the engine and air is passed into the heat chamber and made to burn with the assistance of a catalyst to generate heat of combustion. This heat of combustion is to directly heat the air inside the passenger compartment or to help heating the water supplied to a radiator in the passenger compartment during the period until the temperature of the engine cooling water sufficiently rises.

In a catalytic combustion type heater, the heating element is preheated in order to enable catalytic combustion at the time of startup. A heating means for the preheating is usually provided at the upstream side of the heating element. The flow of air or other gas through the heat chamber supplies the heat to the heating element thereby enabling efficient preheating.

As another heating means, there is the catalytic combustor disclosed in Japanese Unexamined Patent Publication (Kokai) No. 3-140705. In this unit, a heat chamber is divided by a combustion plate having a flame hole formed therein into a downstream portion in which the heating element is disposed and an upstream portion for forming a mixing chamber. The air-fuel mixture is ejected through the flame hole from the upstream portion to the downstream portion where it is ignited by a spark plug or the like to form a flame. The heat of combustion of the combustion gas preheats the heating element. In this catalytic combustor as well, the preheating is efficiently carried out by sending the combustion gas to the heating element from the upstream side. The transition the catalytic combustion is carried out by temporarily increasing the amount of air fed to blow out the flame after the catalyst carried on the heating element reaches the activation temperature.

If this preheating is not sufficiently carried out and the temperature of the heating element remains lower than the activation temperature, there is a danger of incomplete combustion or the like at the time of ignition and of deterioratoin of the exhaust emission. Therefore, a temperature sensor is provided at the heating element to detect the catalyst temperature or a timer is used to count the preheating time so as to judge the completion of the preheating.

On the other hand, at the time of extinguishment, there is a danger of deterioration of the exhaust emission due to the fuel remaining in the heat chamber if the extinguishment is achieved by just stopping the supply of fuel. Therefore, in a flame combustion type liquid fuel combustion apparatus provided with a burner as disclosed in Japanese Unexamined Patent Publication (Kokai) No. 7-293864, at the time of extinguishment, the supply of the fuel is not stopped at one time, but rather the amounts of the fuel and air fed are gradually decreased and the remaining fuel is reduced so as to improve the exhaust emission. It can be considered to apply this to a catalytic combustion type heater.

In the catalytic combustor disclosed in Japanese Unexamined Patent Publication No. 3-140705 and other catalytic combustion type heaters of this type, however, since the heating means for preheating is provided at the upstream side of the heating element as described above, in particular in a large sized heating element having high heating capacity, a temperature difference is apt to occur between the upstream portion near the heating means and the downstream portion and the temperature becomes lower at the downstream portion. Further, in a combustor having such a large sized heating element, before feeding the fuel and air at the time of ignition so as to obtain an amount of feed in accordance with a combustion instruction, control is exercised to raise the amounts of fuel and air fed stepwise starting from small amounts. At this time, however, the temperature does not easily rise at the downstream portion of the heating element since the amounts of fuel and air fed are small. For this reason, unburnt fuel is liable to be produced at the low temperature downstream portion at the time of ignition, so the exhaust emission is not always sufficiently reduced.

Further, when the liquid fuel combustion apparatus disclosed in the above Japanese Unexamined Patent Publication (Kokai) No. 7-293864 is used for a catalytic combustion type heater, particularly in a combustor having a large sized heating element with a high heating capacity, the temperature of the downstream portion of the heating element drops faster as the amounts of fuel and air fed decreases. As a result, in the downstream portion of the heating element, there is a danger that normal catalytic combustion will no longer be carried out before the amount of fuel fed sufficiently decreases, so the effect of reduction of the exhaust emission cannot always be sufficiently expected.

SUMMARY OF THE INVENTION

Therefore, an object of the present invention is to provide a catalytic combustion type heater capable of obtaining a sufficient effect of reduction of the exhaust emission at the time of ignition and at the time of extinguishment even if a catalytic combustion type heater provided with a large sized heating element with a high heating capacity.

To achieve this object, the present invention provides a catalytic combustion type heater as disclosed in the claims.

In the first aspect of the invention disclosed in claim 1, there is provided a catalytic combustion type heater provided with a heating element carrying a catalyst disposed in a heat chamber, circulating fuel fed from a fuel feeding means and air fed from an air feeding means in the heat chamber to form an air-fuel mixture consisting of fuel and air, burning this with the aid of the catalyst, and feeding and stopping the feed of fuel and air by controlling the fuel feeding means and the air feeding means by a controlling means, wherein at the time of ignition, the controlling means sets a precombustion period of the time up until a steady combustion period where the amounts of fuel and air fed are controlled so as to become the amounts fed in accordance with combustion instructions and, at the same time, sets the amounts of fuel and air fed in the precombustion period so as to form an air-fuel ratio larger than the air-fuel ratio in the steady combustion period.

By this, at the time of ignition, an air-fuel mixture with a large air-fuel ratio is sent to the heating element, therefore the temperature at the low temperature downstream portion of the heating element can become a high temperature faster. Accordingly, when the combustor is provided with a large sized heating element, even if a control is exercised to increase the amounts of fuel and air fed stepwise starting from small amounts before feeding the fuel and air so as to obtain amounts of feed in accordance with the combustion instructions, the exhaust emission can be suppressed.

In the preferred embodiment of the invention disclosed in claim 2, in the precombustion period, the amount of air fed is set to the amount fed of the steady combustion period and, at the same time, the amount of fuel fed is set to a smaller amount than the amount fed of the steady combustion period.

In this case, even in the transition from the precombustion period to the steady combustion period, no change of the amount of air fed is necessary, therefore an effect the same as that of the aspect of the invention disclosed in claim 1 can be exhibited by just the simple control of changing the amount of fuel fed.

In the second aspect of the invention disclosed in claim 3, there is provided a catalytic combustion type heater provided with a heating element carrying a catalyst disposed in a heat chamber, circulating fuel fed from a fuel feeding means and air fed from an air feeding means in the heat chamber to form an air-fuel mixture consisting of fuel and air, burning this with the aid of the catalyst, and feeding and stopping the feed of fuel and air by controlling the fuel feeding means and the air feeding means by a controlling means, wherein at the time of extinguishment, the controlling means sets the system so that the feeding of fuel is stopped and, at the same time, only air is fed in an amount of feed smaller than that before the stopping of the feed of fuel and then air is fed for purging.

When the feeding of fuel is stopped at the time of extinguishment, the fuel remaining in the heat chamber only weakly burns. Since the amount of air fed is decreased after stopping the feeding of fuel, the robbing of heat from the heating element by air is suppressed and the temperature of the catalyst is not abruptly lowered even at the low temperature downstream portion of the heating element. Then, for the short time during which the remaining fuel burns, the catalyst holds a sufficiently high temperature, the unburnt fuel is completely burned without incomplete combustion, and generation of exhaust emission is suppressed. The gas after burning is purged thereafter by the feeding of the purging air.

By stopping the feed of fuel, the subsequent combustion time becomes shorter, therefore, as in the preferred embodiment of the invention disclosed in claim 4, by making the amount of air fed in the period from the stoppage of the feed of the fuel to the start of the feed of purging air constant, it is possible to simplify the control of the amount of feed performed by the controlling means.

BRIEF DESCRIPTION OF THE DRAWINGS

The above object and features of the present invention will be more apparent from the following description of the preferred embodiments given with reference to the accompanying drawings, wherein.

DESCRIPTION OF THE PREFERRED EMBODIMENTS

Figure 1:
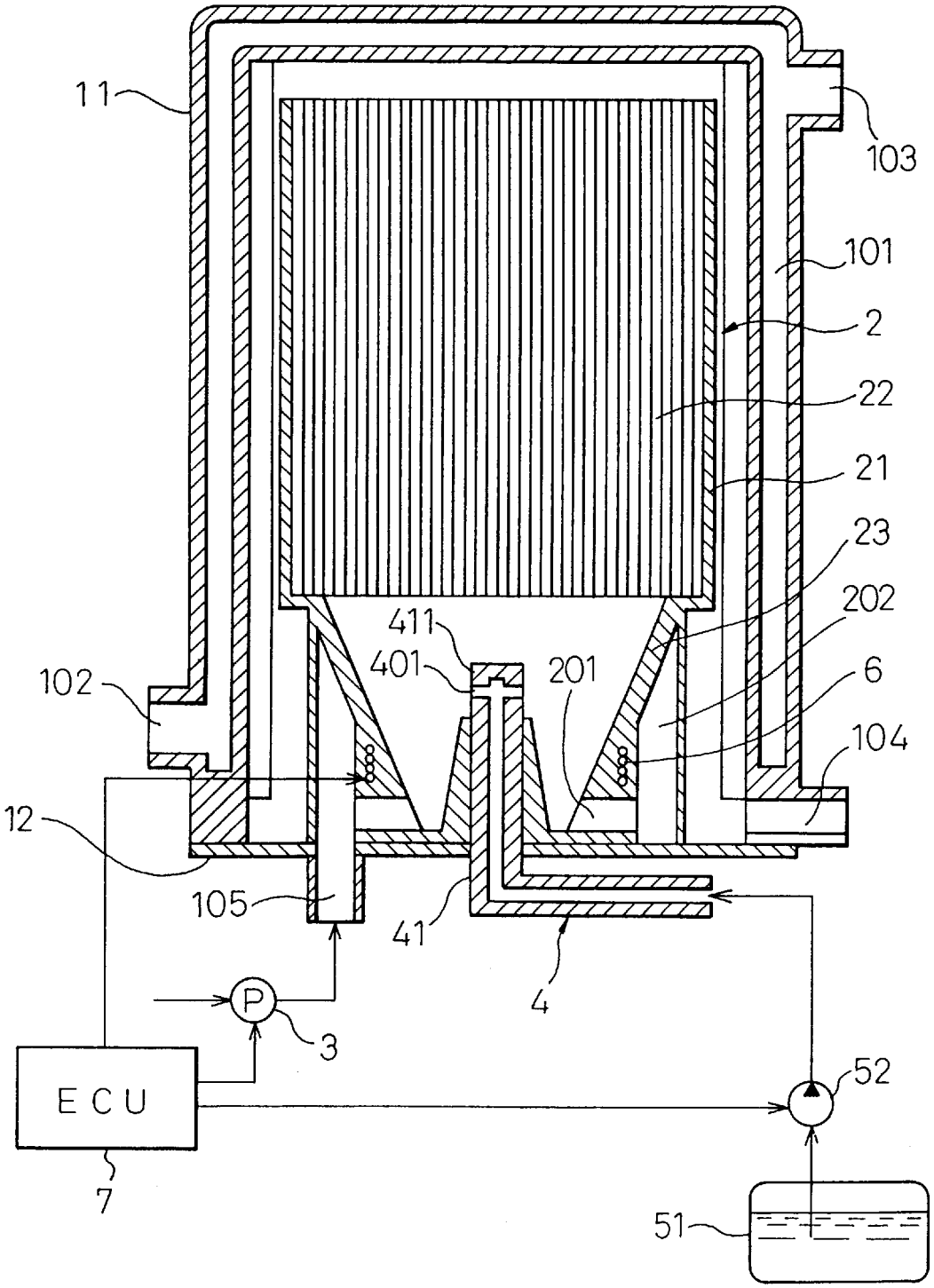
FIG. 1 is a vertical sectional view of the overall configuration of a catalytic combustion type heater according to an embodiment of the present invention.

FIG. 1 shows a catalytic combustion type heater according to an embodiment of the present invention. In the catalytic combustion type heater, a combustion portion 2 for generating a high temperature combustion gas is accommodated in a housing 11 shaped as a drum with a bottom. An open end of the housing 11 is closed by a lid member 12. In the housing 11 is formed a flow path 101 for circulating water. An inflow port 102 and an outflow port 103 of the flow path 101 are formed in a wall of the housing 11. They are connected by a not illustrated heat exchanger and pipe provided in the passenger compartment. The circulating water circulates between the flow path 101 and the heat exchanger and carries the heat received from the combustion gas to the heat exchanger. An exhaust port 104 from which is exhausted the combustion gas after discharging the heat to the circulating water is formed at a base portion side of the side wall of the housing 11.

The combustion portion 2 is provided with a heat chamber 21 having a slightly smaller diameter than the inner diameter of the housing 11. One open end thereof is affixed to the lid member 12. At the above open end of the heat chamber 21 is fitted a heating element 22 comprised of a carrier made of a honeycomb-shaped ceramic carrying the catalyst while leaving space for installation of a fuel vaporizer 23 explained later.

The fuel vaporizer 23 is integrally provided with the heating element 22. The fuel vaporizer 23 has a schematically conical form and has an upper end opening facing the heating element 22. A plurality of intake ports 201 are formed in a bottom side wall of the fuel vaporizer 23 and connect a space 202 between the heat chamber 21 and the fuel vaporizer 23 with the interior of the fuel vaporizer 23.

The lid member 12 is provided with an air inflow port 105 for passing the air sent from an air pump 3 used as the air feeding means into the space 202. The air from the air pump 3 flows into the fuel vaporizer 23 via the air inflow port 105, the space 202, and the intake port 201. The air flowing into the fuel vaporizer 23 forms a gas flow passing through the honeycomb-shaped heating element 22.

The fuel vaporizer 23 is fed with the fuel stored in a fuel tank 51 by a fuel pump 52 used as the fuel feeding means via an L-shaped fuel feed pipe 4. The vertical portion 41 of the fuel feed pipe 4 penetrates through the lid member 12. The front end portion 411 projects into the fuel vaporizer 23 and reaches to about the middle of the fuel vaporizer 23. A plurality of injection ports 401 are formed in the wall of this front end portion 411. The fuel is injected from them into the fuel vaporizer 23.

An electric preheating heater 6 is embedded in a circumferential wall of the fuel vaporizer 23 in the form of a coil. The preheating heater 6 heats the fuel vaporizer 23. The heat is propagated to the heating element 22 in contact with the upper end surface of the fuel vaporizer 23 directly or via the heat chamber 21. Alternatively, it is radiated from the inner circumferential surface of the fuel vaporizer 23 to the heating element 22. Alternatively, the heat is received at the inner circumferential surface of the fuel vaporizer 23 by the gas flow formed by the air sent from the air pump 3 and fed to the heating element 22.

The pump 3, the fuel pump 52, and the preheating heater 6 are connected to a control circuit 7 used as the controlling means. The supply of power is controlled by the control circuit 7. The control circuit 7 feeds and stops the feed of the fuel and air by this control of the power supply and turns on or off the preheating of the heating element 22. The control circuit 7 memorizes the amounts of fuel and air fed in accordance with the heating capacity required for heating until the temperature of the engine coolant sufficiently rises and controls the air pump 3 etc. by using the amounts of feed as combustion instruction values. A sufficient heat of combustion is obtained when the air-fuel ratio of the air-fuel mixture of the amounts of fuel and air fed is usually about 50.

Figure 2:
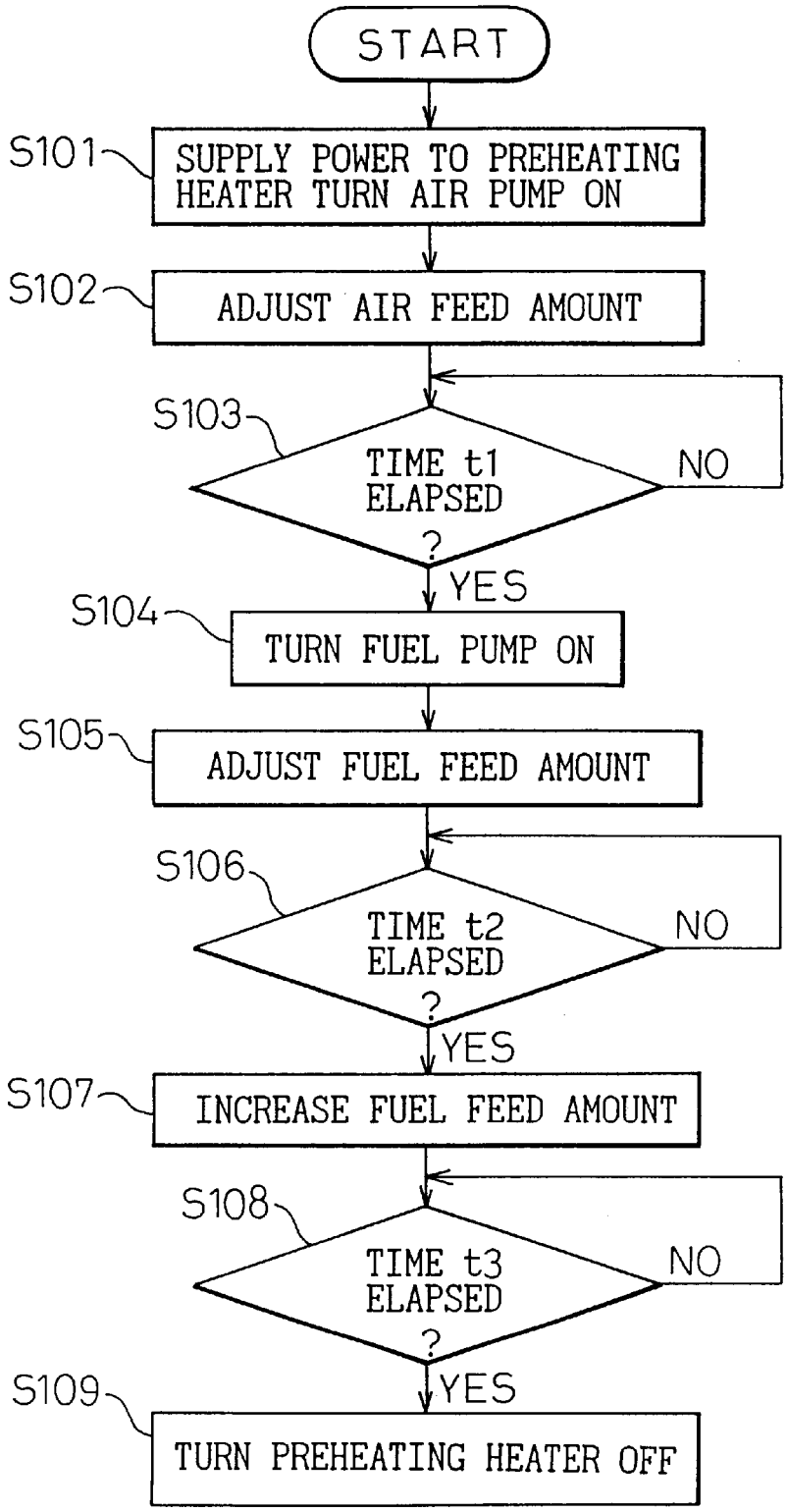
FIG. 2 is a first flowchart for explaining an operation of the catalytic combustion type heater of the embodiment.
Figure 3:
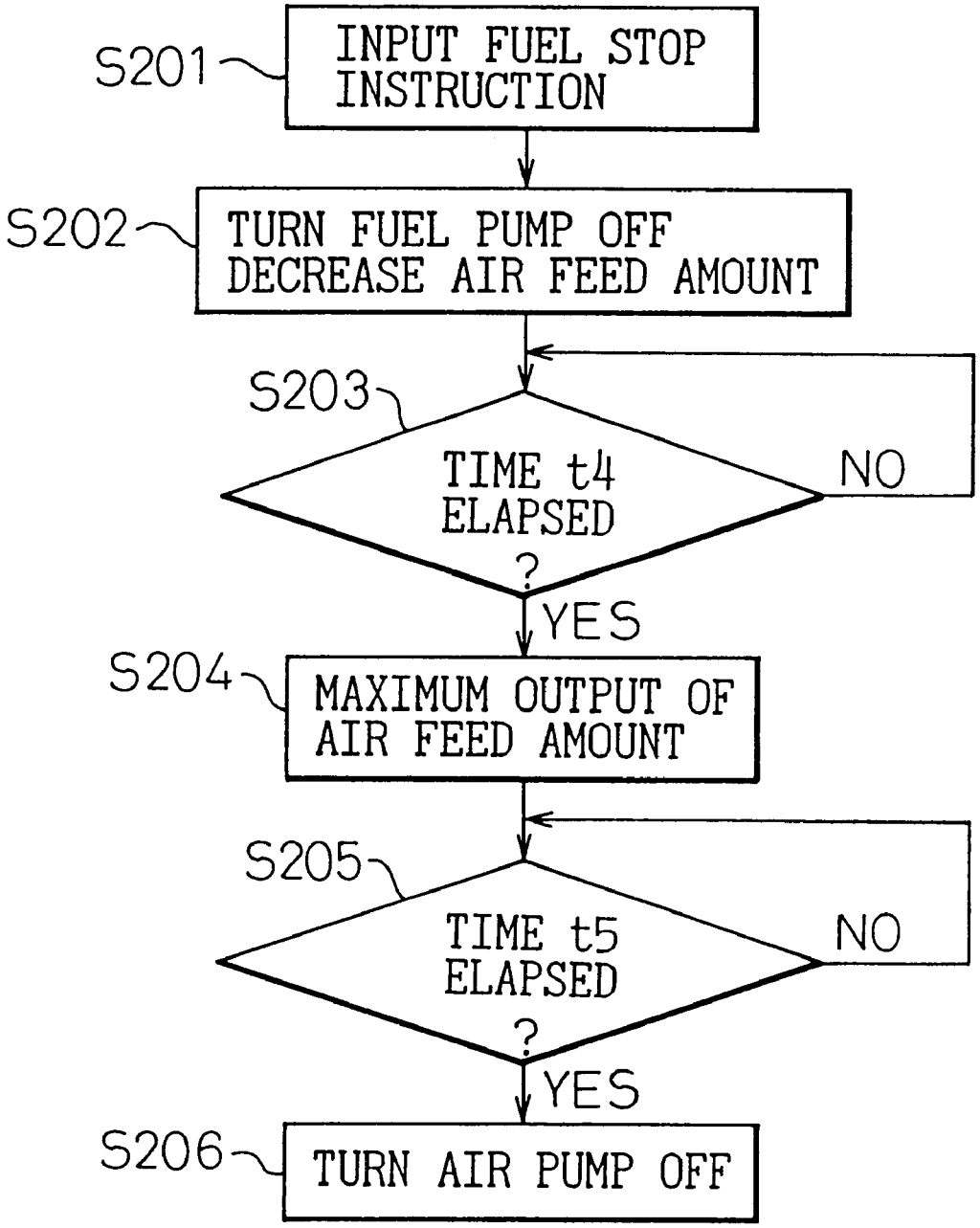
FIG. 3 is a second flowchart for explaining the operation of the catalytic combustion type heater of the embodiment.
Figure 4:
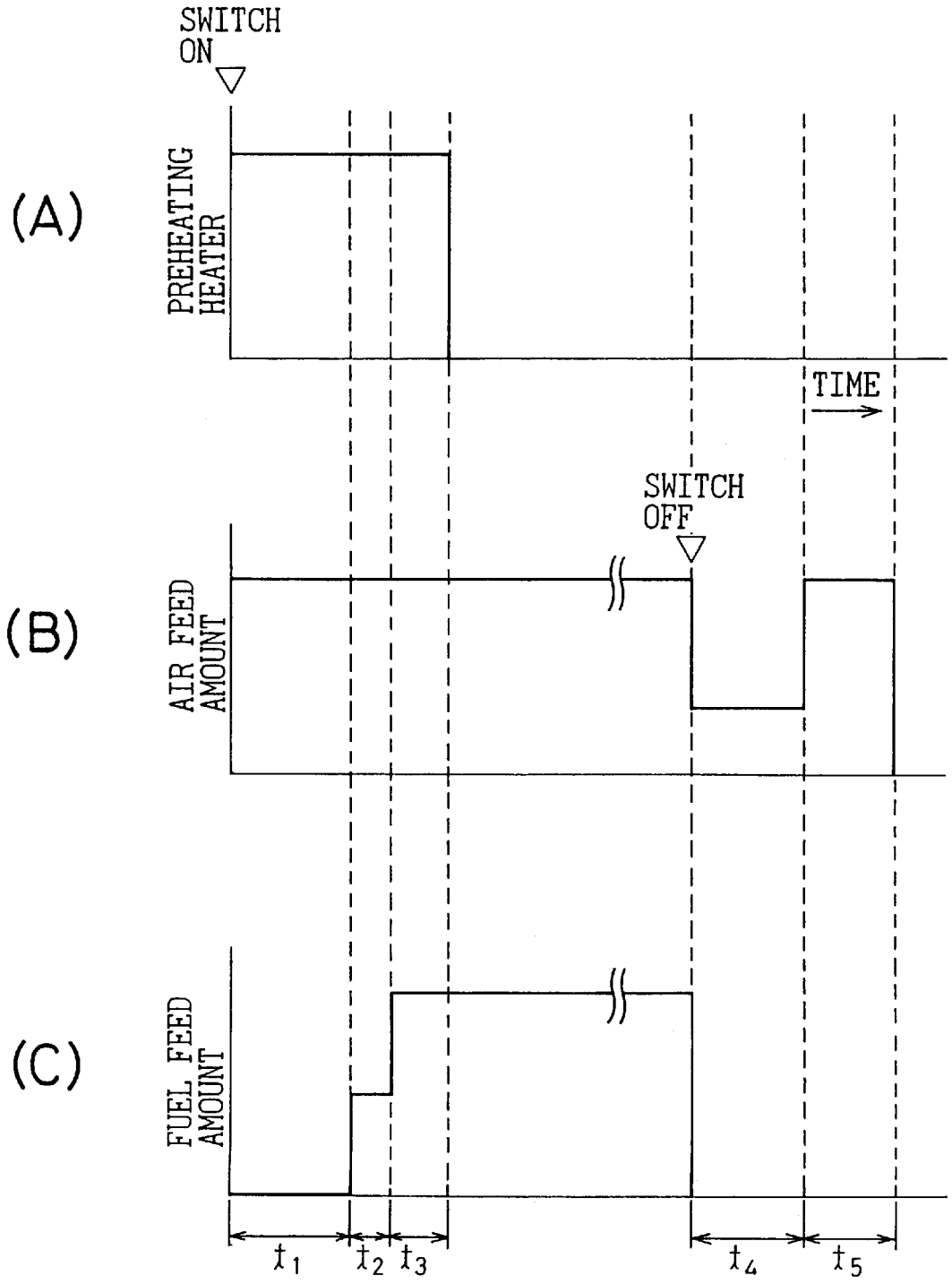
FIG. 4 is a timing chart for explaining the operation of the catalytic combustion type heater of the embodiment.

The operation of the catalytic combustion type heater will be explained next. FIG. 2 is a flow chart of the control by the control circuit 7 at the time of ignition. FIG. 3 is a flow chart of the control by the control circuit 7 at the time of extinguishment. FIG. 4 is a timing chart showing the operating state of portions of the catalytic combustion type heater, in which (A) shows an on/off state of the preheating heater 6; (B) shows the amount of air fed (air feed amount in the figure) from the air pump 3 to the heating element 21; and (C) shows the amount of fuel fed from the fuel pump 52 to the fuel vaporizer 23.

In FIG. 2, the flow of control at the time of ignition starts by the turning on of a not illustrated heater switch. Electric power is supplied to the preheating heater 6 at step S101 ((A) of FIG. 4). Further, the air pump 3 is turned on and air is fed from the air pump 3 via the air inflow port 105 into the fuel vaporizer 23 ((B) of FIG. 4), whereby a gas flow heading from the fuel vaporizer 23 toward the heating element 22 is formed in the heat chamber 21. The amount of air fed is adjusted to a value corresponding to the combustion instruction value at step S102.

The fuel vaporizer 23 and the heating element 22 are preheated by the heat generated by the preheating heater 6. This preheating is carried out for exactly a time t1 after turning on the heater switch. The preheating time t1 is a time required for the temperature of the catalyst of the heating element 22 to rise up to the activation temperature by the heating by the preheating heater 6 and is found in advance by measurement of the catalyst temperature.

After the period of preheating, a precombustion period is provided. Steps S104 to S106 are for the operation in the precombustion period. When the preheating time t1 elapses (step S103), the operation routine proceeds to step S104, at which the fuel pump 52 is turned on and the fuel discharged from the fuel pump 52 is sent to the fuel feed pipe 4 ((C) of FIG. 4) and injected from the injection ports 401 into the fuel vaporizer 23. The injected fuel robs the heat of vaporization from the heated fuel vaporizer 23 and vaporizes. By this, a flow of an air-fuel mixture comprising the fuel and air heading from the interior of the fuel vaporizer 23 to the heating element 22 is formed in the heat chamber 21. At step S105, the amount of fuel fed is adjusted so that the air-fuel ratio becomes 100.

The precombustion period continues for exactly a time t2. In the precombustion period, in contrast to the fact that the air-fuel ratio of the amounts of fuel and air fed in accordance with the combustion instruction value is 50, the air-fuel ratio is 100 so the ratio of air is large. Accordingly, incomplete combustion or the like is unlikely to occur and the exhaust emission is reduced. Further, the catalyst temperature rises in this period and reaches a further higher temperature than the temperature at the end of the preheating period. Note that the time t2 of the precombustion period is a time required until the catalyst temperature reaches the predetermined high temperature and is found by measuring the temperature of the heating element 22 in advance.

When the time t2 elapses and the precombustion period is terminated, the operation routine proceeds to step S107. At step S107, the amount of fuel fed is increased up to the amount of feed in accordance with the combustion instruction ((C) of FIG. 4). The steady combustion period is exhibited thereafter. The air-fuel ratio of the air-fuel mixture is lowered from 100 to 50 in the steady combustion period. A sufficient heat of combustion is generated by this air-fuel mixture containing a large amount of fuel.

The change from this precombustion period to the steady combustion period is achieved by just a change of the amount of fuel fed since the amount of air fed is adjusted to a value in accordance with the combustion instruction at step S102. Therefore, the control is simplified.

The air-fuel mixture stably burns at the heating element 22 carrying the catalyst. The combustion gas is ejected from the front end portion side of the housing 11 of the heat chamber 21 and flows along the inner wall surface of the housing 11 toward the base portion side. During this time, the circulating water flowing through the circulating water flow path 101 in the housing 11 receives the heat from the combustion gas, rises in temperature, and is used for the heating of the interior of the not illustrated passenger compartment. Then, the combustion gas is exhausted from the exhaust port 104 to the outside.

By a sufficient heat of combustion is generated at the heating element 22 and thereby the heating element 22 and the fuel vaporizer 23 in the housing 11 are exposed to a high temperature atmosphere, the heating by the preheating heater 6 is unnecessary. Therefore, when the operation routine enters into the steady combustion period and the time t3 elapses (step S108), the supply of power to the preheating heater 6 is turned off ((A) of FIG. 4).

Further, the time t1 of the preheating period and the time t2 of the precombustion period are fixed to target values for counting by the timer, but in certain cases, it is also possible to adopt a configuration which uses not a timer in this way, but a temperature sensor for detecting the catalyst temperature provided at the heating element 22 and compares the temperature detected by the temperature sensor with a predetermined temperature set in advance so as to decide whether to continue or end the period.

Next, the operation at the time of extinguishment will be explained by FIG. 3 and FIG. 4. When the coolant temperature of the engine rises and heating by the now hot engine cooling water becomes possible, the heater switch is turned off and a combustion stop instruction is input to the control circuit 7 (step S201). According to this, the operation of the combustion pump 52 is stopped and the feeding of fuel is stopped ((C) of FIG. 4) and, at the same time, the supply of power to the air pump 3 is reduced and the amount of air fed is decreased to ⅓ of the feed amount at the time of input of the combustion stop instruction (step S202, (B) of FIG. 4). This state continues for exactly a time t4 after the feed of fuel is stopped.

While new fuel stops being fed due to the fuel pump 52 being turned off, a small amount of fuel which has been already injected from the injection pipe 4 remains in the fuel vaporizer 23 etc. This fuel and the fed air form a weak combustion. Since the amount of air fed has been made small, the temperature of the catalyst of the heating element 22 is not abruptly lowered during the short time in which the small amount of remaining fuel burns. In this way, the remaining fuel is completely burnt without incomplete combustion.

Since the combustion after the feed of fuel is stopped is short duration combustion by the remaining fuel, the amount of air fed does not have to be decreased in accordance with the amount of fuel. There is no problem even if the amount fed is made constant.

When the time t4 elapses after the feed of fuel is stopped (step S203), the discharge of the air pump 3 is raised to the maximum to maximize the amount of the air fed (step S204) so as to purge the gas and heat in the heat chamber 21. Note that, in the illustrated example, the amount of air fed at the time of maximum output is the same as the amount fed before the reduction to ⅓.

Then, when a time t5 elapses after the discharge of the air pump 3 is raised to the maximum (step S205), the air pump 3 is turned off (step S206) and all operations of the catalytic combustion type heater are terminated.

Note that the specific figures mentioned in the explanation are just examples. The optimum values of these figures are set in accordance with the required specifications etc. In this case, it is preferable to find more effective values for the air-fuel ratio in the precombustion period and the amount of decrease of the amount of air fed after the fuel stops being fed by experiments.

Further, in the illustrated embodiment, the control circuit 7 was configured so as to improve the exhaust emission at both of the time of ignition and the time of extinguishment by executing both of the control flows of FIG. 2 and FIG. 3, but if desiring to improve the exhaust emission at just one of the time of ignition or the time of extinguishment, a configuration executing only one of the control flows of FIG. 2 or FIG. 3 may be adopted.

Further, in the illustrated embodiment, the amounts of air fed in the precombustion period and the steady combustion period were made the same, but they do not always have to be the same and may be set so that the air-fuel ratio of the precombustion period is larger than the air-fuel ratio of the steady combustion period in accordance with the combustion instruction. For example, when the present invention is applied to a heater having a large sized heating element, it is also possible to increase the combustion amount stepwise by setting the amounts of the fuel and air fed to stepwise increase while holding the air-fuel ratio larger than the air-fuel ratio of the amounts of the fuel and air fed in accordance with the combustion instruction in the precombustion period.

Figure 5:
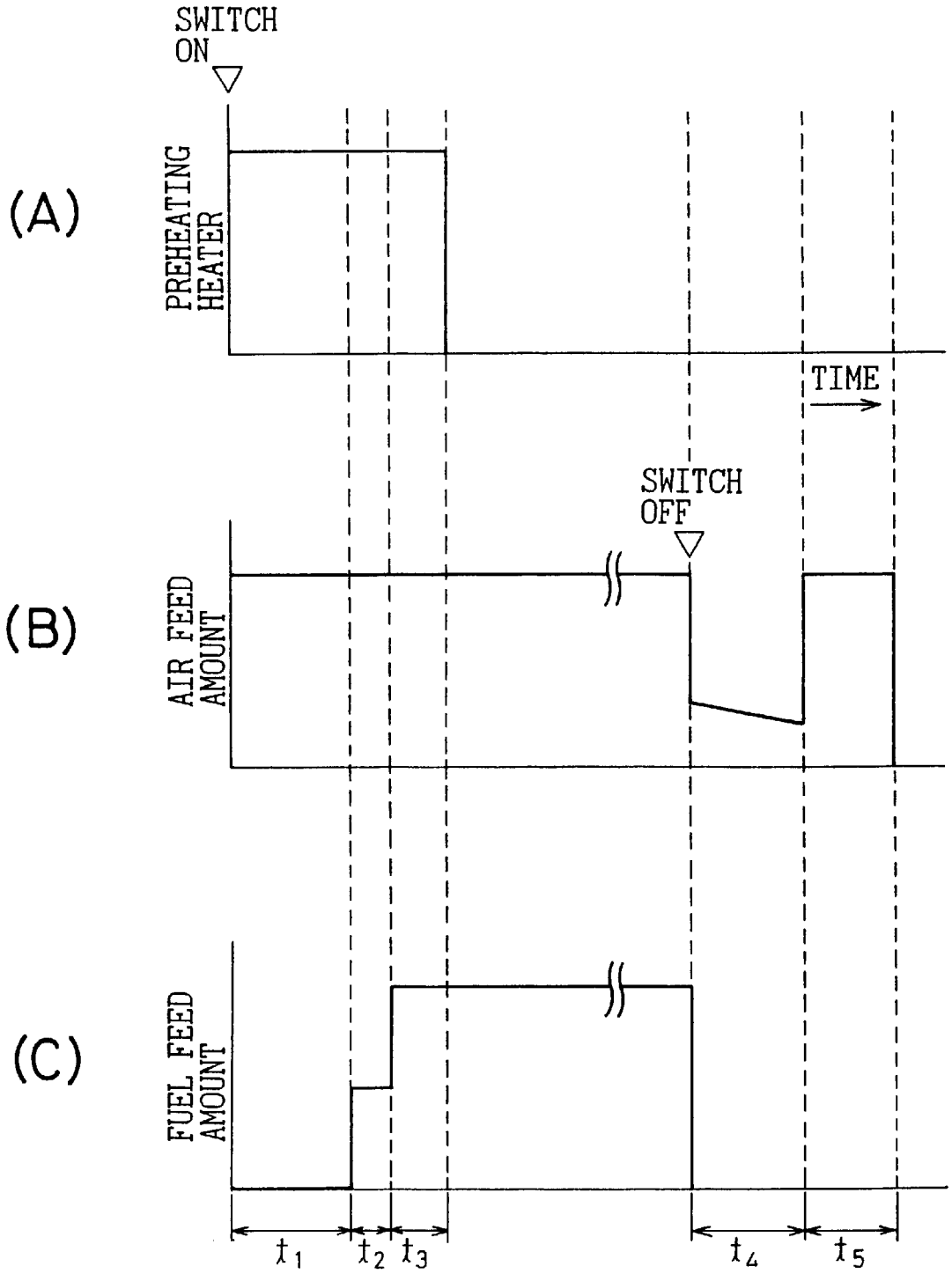
FIG. 5 is a timing chart for explaining the operation of the catalytic combustion type heater of another embodiment.

Further, while the amount of air fed after the fuel stopped being fed was made constant until the start of the purge, of course it is also possible to reduce it steadily (as shown in FIG. 5).

Further, while the embodiment was one for heating of a vehicle, it is also possible to apply the present invention to a catalytic combustion type heater used for heating other objects.

While the invention has been described by reference to specific embodiments chosen for purposes of illustration, it should be apparent that numerous modifications could be made thereto by those skilled in the art without departing from the basic concept and scope of the invention.

What is claimed is:

1. A catalytic combustion type heater comprising:

a heating element carrying a catalyst;

a heat chamber having said heating element disposed inside and circulating inside said heat chamber an air-fuel mixture consisting of a fuel and air;

a fuel feeding means for feeding the fuel into said heat chamber;

an air feeding means for feeding the air into said heat chamber; and a controlling means for controlling said fuel feeding means and air feeding means to start the feed, feed, and stop the feed of the fuel and the air, wherein a precombustion period prior to combustion of the air/fuel mixture is set after starting said heater and before the operation of said heater enters into a steady combustion period by said controlling means, the amounts of the fuel and the air being fed in said steady combustion period are determined in accordance with a combustion instruction, the amount of the fuel being fed in said precombustion period is set so as to be smaller than the amount of the fuel being fed in said steady combustion period, and an air-fuel ratio of the amounts of the fuel and the air being fed in said precombustion period is set so as to be larger than the air-fuel ratio of the amounts of the fuel and the air being fed in said steady combustion period.

2. A catalytic combustion type heater according to claim 1, wherein, in said precombustion period, the amount of air fed is set so as to become the same as the amount of air fed in said steady combustion period and the amount of fuel fed is set so as to become smaller than the amount of fuel fed in said steady combustion period.

3. A catalytic combustion type heater comprising:

a heating element carrying a catalyst;

a heat chamber having said heating element disposed inside and circulating inside said heat chamber an air-fuel mixture consisting of a fuel and air;

a fuel feeding means for feeding the fuel into said heat chamber;

an air feeding means for feeding air into said heat chamber; and a controlling means for controlling said fuel feeding means and air feeding means to start the feed, feed, and stop the feed of the fuel and the air, wherein control is exercised by said controlling means so that the feeding of the fuel is stopped at the time of heater extinguishment, only the air is being fed during a predetermined time period between the time the fuel feed is started, wherein the amount of air being fed is lower than that being fed in a steady, combustion time period of the heater, and thereafter, for purging, the air is fed in a flow amount equal to the air flow fed in said steady combustion period.

4. A catalytic combustion type heater according to claim 3, wherein the amount of the air being fed is set to become constant in a period from when the fuel stops being fed to the feeding of the air for purging.

5. A catalytic combustion type heater comprising:

a heating element carrying a catalyst;

a heat chamber having said heating element disposed inside and circulating inside said heat chamber an air-fuel mixture consisting of a fuel and air;

a fuel pump feeding the fuel into said heat chamber;

an air pump feeding air into said heat chamber; and a control circuit controlling said fuel pump and air pump to start the feed, feed, and to stop the feed of the fuel and the air, wherein a precombustion period prior to combustion of the air-fuel mixture is set after starting said heater and before the operation of said heater enters into a steady combustion period by said control circuit;

the amounts of the fuel and the air being fed in said steady combustion period are determined in accordance with a combustion instruction, the amount of the fuel being fed in said precombustion period is set so as to be smaller than the amount of the fuel being fed in said steady combustion period, and an air-fuel ratio of the amounts of the fuel and the air being fed in said precombustion period is set so as to be larger than the air-fuel ratio of the amounts of the fuel and the air being fed in said steady combustion period.

6. A catalytic combustion type heater according to claim 5, wherein, in said precombustion period, the amount of air fed is set so as to become the same as the amount of air fed in said steady combustion period and the amount of fuel fed is set so as to become smaller than the amount of fuel fed in said steady combustion period.

7. A catalytic combustion type heater comprising:

a heating element carrying a catalyst;

a heat chamber having said heating element disposed inside and circulating inside said heat chamber an air-fuel mixture consisting of a fuel and air;

a fuel pump feeding the fuel into said heat chamber;

an air pump feeding air into said heat chamber; and a control circuit controlling said fuel pump and air pump to start the feed, feed, and stop the feed of the fuel and the air, wherein control is exercised by said control circuit so that the feeding of fuel is stopped at the time of heater extinguishment, only the air is being fed during a predetermined time period after the time the fuel feed is stopped wherein the amount of air being fed is lower than that being fed in a steady, combustion time period of the heater, and thereafter, for purging, the air is fed in a flow amount equal to the air flow fed in said steady combustion period.

8. A catalytic combustion type heater according to claim 7, wherein the amount of the air being fed during the predetermined time period is set to become constant in the predetermined time period from when the fuel stops being fed to the feeding of air for purging.

* * * * *